US009248362B2

(12) United States Patent
Durant

(10) Patent No.: US 9,248,362 B2
(45) Date of Patent: Feb. 2, 2016

(54) TABLE TENNIS PADDLE AND BALL HOLDER

(71) Applicant: Russell Durant, Byfield, MA (US)

(72) Inventor: Russell Durant, Byfield, MA (US)

( * ) Notice: Subject to any disclaimer, the term of this patent is extended or adjusted under 35 U.S.C. 154(b) by 145 days.

(21) Appl. No.: 14/103,896

(22) Filed: Dec. 12, 2013

(65) Prior Publication Data

US 2014/0332484 A1 Nov. 13, 2014

Related U.S. Application Data

(60) Provisional application No. 61/736,724, filed on Dec. 13, 2012.

(51) Int. Cl.
*A63B 71/00* (2006.01)
*A63B 47/00* (2006.01)

(52) U.S. Cl.
CPC ..... *A63B 71/0045* (2013.01); *A63B 47/002* (2013.01); *A63B 2102/16* (2015.10); *A63B 2243/0091* (2013.01)

(58) Field of Classification Search
CPC .... A63B 71/0036; A63B 55/10; A63B 55/02; A63B 2243/0091; A63B 47/002; A63B 67/04; A63B 59/04; A63B 71/0045
USPC ..... 211/70.2, 85.7
See application file for complete search history.

(56) References Cited

U.S. PATENT DOCUMENTS 1,421,955 A * 7/1922 Kemp ..... A63B 55/02 2/247
1,699,048 A * 1/1929 Connor ..... A63B 55/00 206/315.5
2,024,484 A * 12/1935 Smith ..... A63B 55/10 224/919
2,570,504 A * 10/1951 Van House ..... B62B 1/262 211/14
2,590,154 A * 3/1952 Burns ..... B62B 1/262 206/315.2
2,767,854 A * 10/1956 Barrett ..... A63B 67/04 211/14
3,064,823 A * 11/1962 Shock ..... A63B 67/04 211/15
3,531,136 A * 9/1970 Mobley ..... A63B 55/08 280/30
3,842,979 A * 10/1974 Doelcher ..... A63B 71/0045 211/14
3,858,725 A * 1/1975 Pietrack ..... A63B 71/0045 211/74
4,082,209 A * 4/1978 Sanders ..... A63B 47/002 211/15
4,241,836 A * 12/1980 Cousins ..... A63B 71/0045 211/14
4,834,444 A * 5/1989 Young ..... A63B 55/04 206/315.2
4,936,467 A * 6/1990 Bobeczko ..... A47F 7/00 211/14
5,184,735 A * 2/1993 Black ..... A47G 1/12 211/14
5,368,172 A * 11/1994 Barringer ..... A63B 71/0045 211/15
5,417,334 A * 5/1995 Wu ..... A63B 55/04 206/315.2
5,472,189 A * 12/1995 Pfeiffer ..... A63B 67/04 221/155
5,632,386 A * 5/1997 Gabhart ..... A63B 71/0045 211/14
5,820,499 A * 10/1998 Thomas ..... A63B 47/002 211/14

(Continued)

*Primary Examiner* — Patrick Hawn

(57) ABSTRACT

A wall-mounted invention used for the display, storage and retrieval of table tennis paddles and balls. Using mounted tension clips for storing paddles across a faceplate attached at each end to cylindrical ball-dispensers. This is the first invention to allow for preferred paddle selection. The ability to pick your preferred paddle without having to sift through other paddles stored immediately in front of or in the same storage slot/insert. While some prior art have balls resting in individual circular impressions/dimples that are susceptible to dust, undesired ball-spills, and requiring individual placement and retrieval; while others contain balls within an elaborate box or mounted in a device attached directly on/to the table itself. This invention combines the benefits of prior art to store balls in proper holding position, eliminates ball jams, prevents collection of dust from vertical fall and deters balls from undesired ball-spills; and does not interfere with game play.

11 Claims, 9 Drawing Sheets

(56) References Cited

Figure 1:
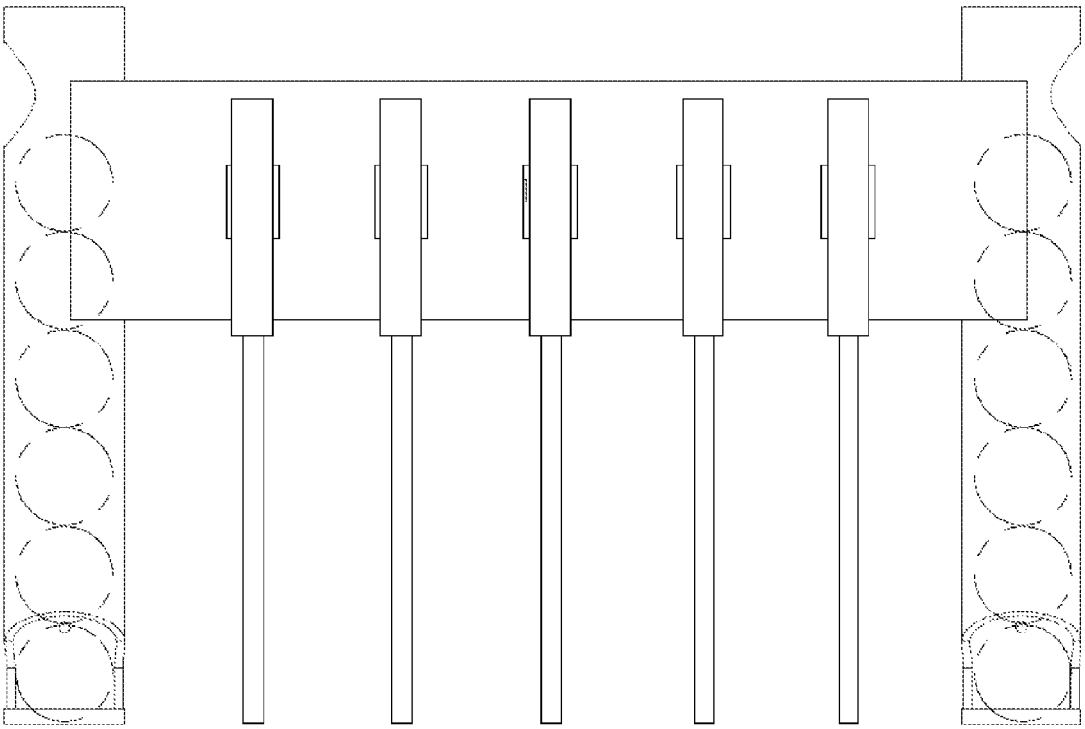

U.S. PATENT DOCUMENTS 6,032,999 A * 3/2000 York ..... A63B 55/10 211/70.2
8,157,677 B1 * 4/2012 Chen ..... A63B 67/045 211/13.1
8,182,374 B1 * 5/2012 Copeland ..... A63B 59/04 473/473
2007/0034641 A1 * 2/2007 Huang ..... A45F 5/00 221/269
2009/0152220 A1 * 6/2009 Young ..... A63B 55/00 211/70.2

* cited by examiner

TABLE TENNIS PADDLE AND BALL HOLDER

CROSS-REFERENCE TO RELATED APPLICATIONS

This application claims the benefit of U.S. Provisional Application No. 61/736,724, filed Dec. 13, 2012.

BACKGROUND OF THE INVENTION

1. Circumstance and Date of Conception

Sometime in the winter of 1992, I lay in my hospital bed recovering from my second bone marrow transplant due to Leukemia. I had built a new home in July of the same year and had lived in it for 3-weeks before heading to the hospital. I had plenty of spare time to plan the layout of my game-room that my basement would become. Amongst, my many needs, I wanted a device to hang my table tennis paddle and balls. I began searching the internet for such devices and found nothing of any merit. From that point forward (in between my life) I began thinking/drafting ideas. I began designing in 2004 and made my first prototype out of a toilet paper roll. I sent my first design out for bid in 2005. First working prototype was created in December of 2005.

2. Field of Invention

This invention most closely aligns with Class 473 Games Using Tangible Projectile, Subclass: 553, section (c) any device intended to be attached to or carried by a racket or paddle when it is not being used for its function of striking a projectile (e.g., a ball carrier attachable to a table tennis paddle, etc.)

DESCRIPTION OF RELATED ART

There have been several patents issued for devices that can hold either table tennis balls and/or paddles. I don't believe any of the prior art have accomplished the task with as simple, functional and as attractive design as this invention.

Prior art include U.S. Pat. No. 5,368,172 Barringer & U.S. Pat. No. 5,632,386 Gabhart. The Barringer invention provides for the holding of table tennis equipment with a focus on, handle abrasion reduction and reducing the depth of the product to avoid accidental collision with humans. The Barringer device holds paddles in two "inserts" (shaped like duck feet) one paddle loaded on top of the other. So if you wanted your favorite paddle, you may have to remove two or possibly 5 paddles (if fully loaded) to obtain your preferred paddle.

The ball holder mechanism is complicated in design and would appear susceptible to ball jams. The ball dispenser is a moving part and would appear to be susceptible for malfunction.

The Gabhart invention likewise accomplishes the task of storing balls and paddles, but on the table instead of a wall in close proximity to the table tennis play area. The invention is limited to two paddles and two balls and is mounted directly onto the table. The major issue in this design is that a player, paddle or ball may accidently come in contact with the invention or its contents during play.

It is the intent of this invention to consider the pros and cons of the prior art, combined with new use features effective and efficient storage of table tennis paddles and balls that allow for selection of "favorite" paddle, durable product, and make improvements in design, functionality and attractiveness to players. Additional new uses include the ability to hang paddle bag carriers by magnetic hook attached to the bottom of the invention; Balls sort themselves in position for dispensing once dropped into the ball-input dispensers. The invention provides an auxiliary storage shelf for additional miscellaneous table tennis paraphernalia.

BRIEF SUMMARY OF THE INVENTION

The invention is a wall-mounted table tennis paddle and ball holder. It is comprised of two table tennis ball dispensers connected by a faceplate where table tennis paddles are hung (with an additional clip accessory suitable for such purposes.)

The ball dispensers offer storage for 40 mm balls. Each dispenser is capped at the top to prevent dust from landing on the stored balls. Each dispenser also provides holes for securing the device to a wall. Balls are hand-loaded from either top side into the dispensers and free fall into place. The bottom of the dispenser contains a catch-basin that displays next ball in line to be dispensed as well as securing the ball(s) from dispensing on their own. A ball and/or paddle are extracted by hand for game play.

BRIEF DESCRIPTION OF THE SEVERAL VIEWS OF DRAWINGS

Figure 2:
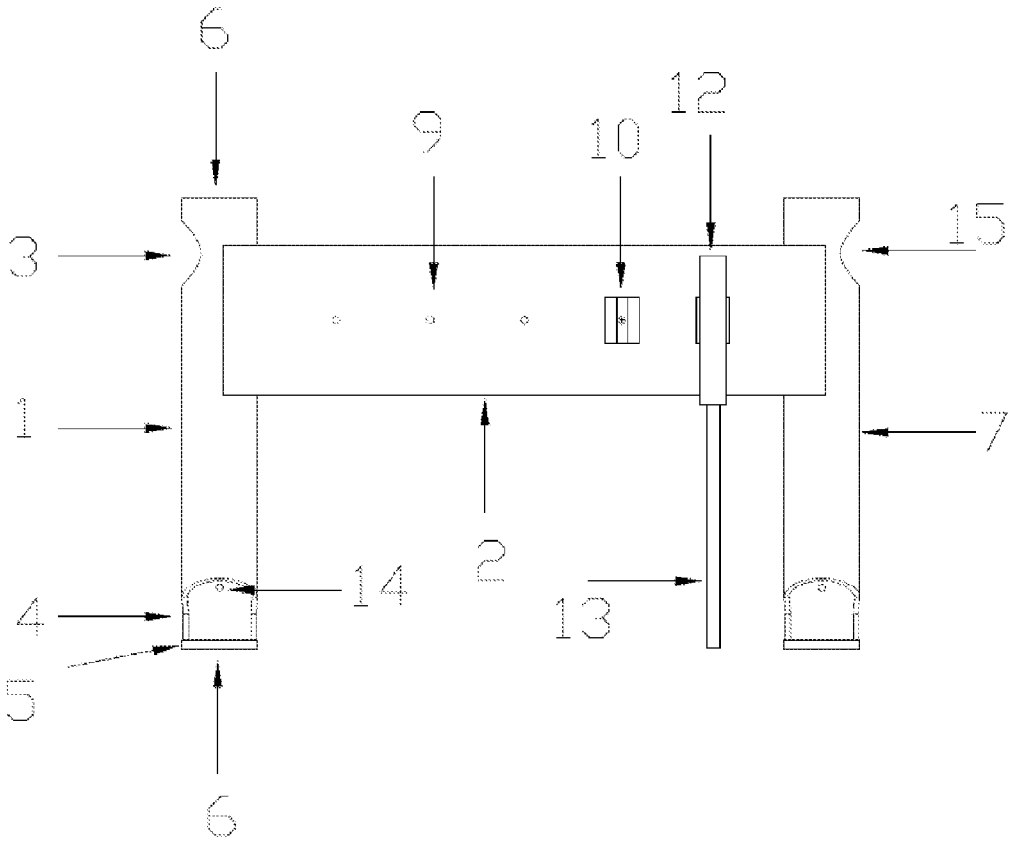
Figure 3:
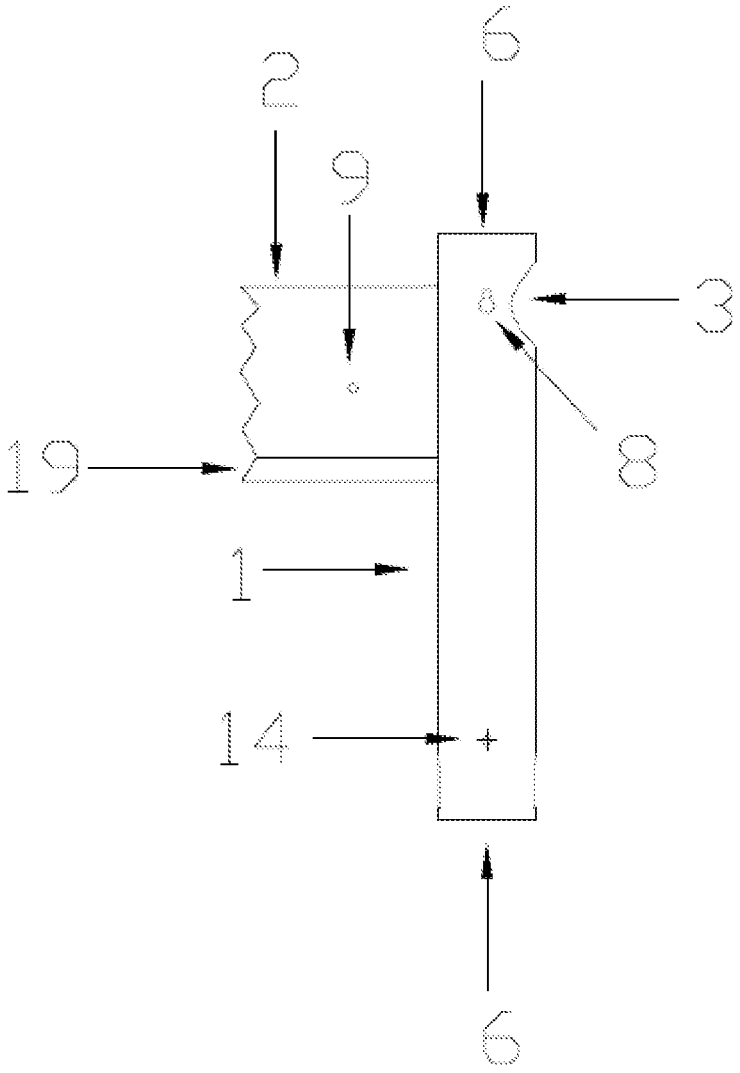
Figure 4:
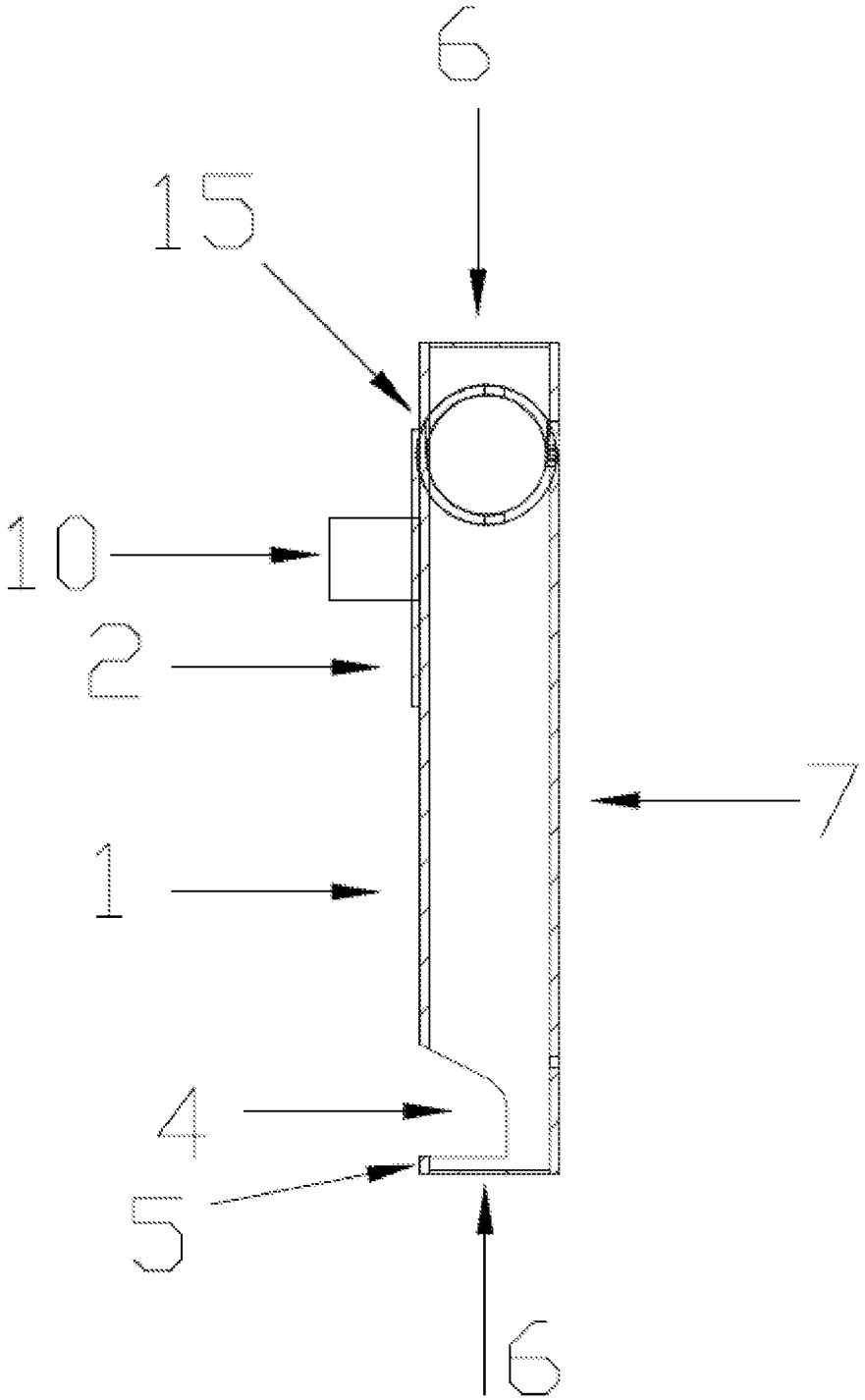
Figure 5:
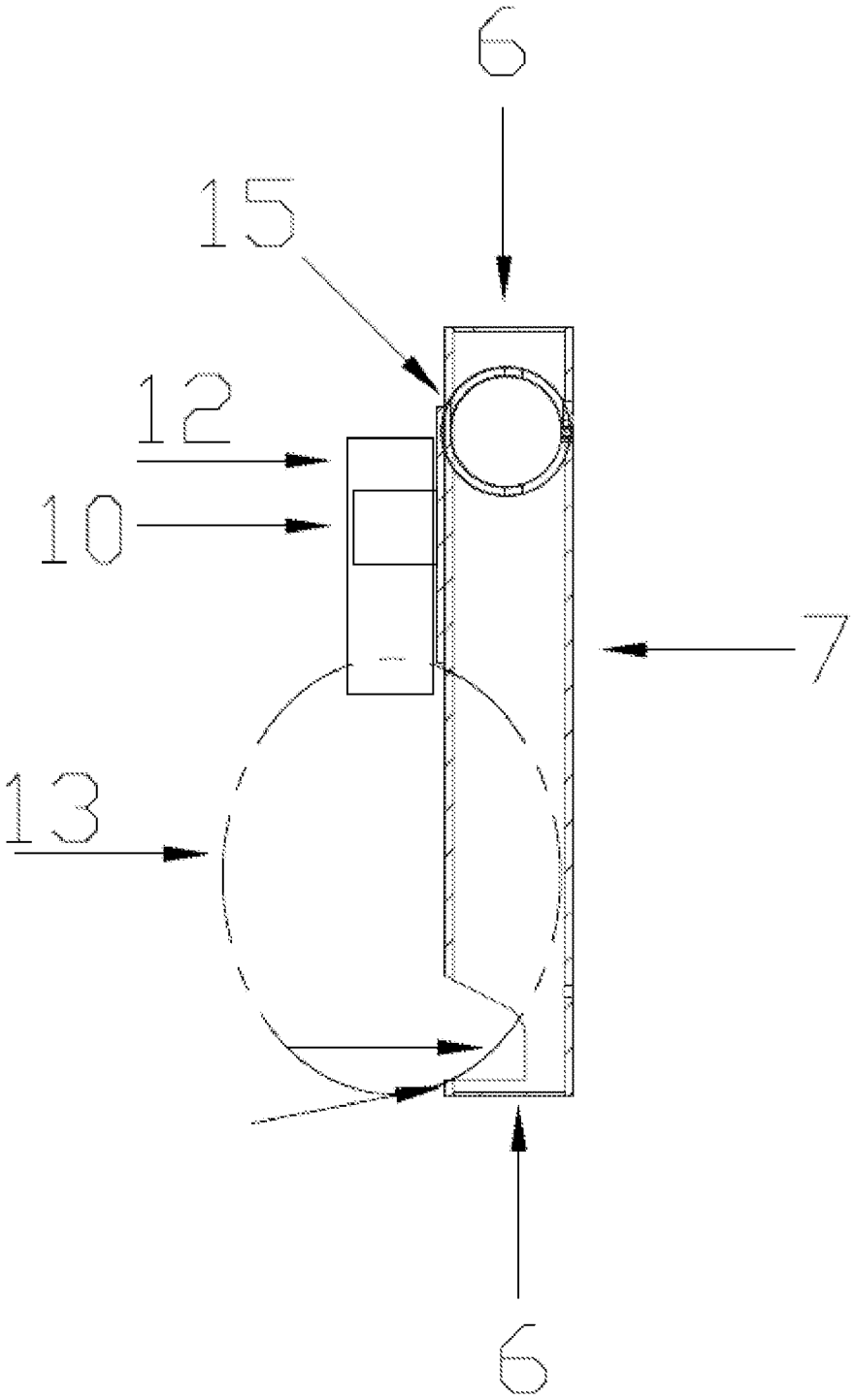

FIG. 1 a schematic front view of the invention, showing 5-paddles mounted on clips and a partially-transparent view of 6-balls in each ball-dispenser FIG. 2 a detailed front view parts and features FIG. 3 a detailed rear cut-away view FIG. 4 a detailed right side view FIG. 5 a detailed right side view, shown with a partially-transparent view of a hung paddle.

Figure 6:
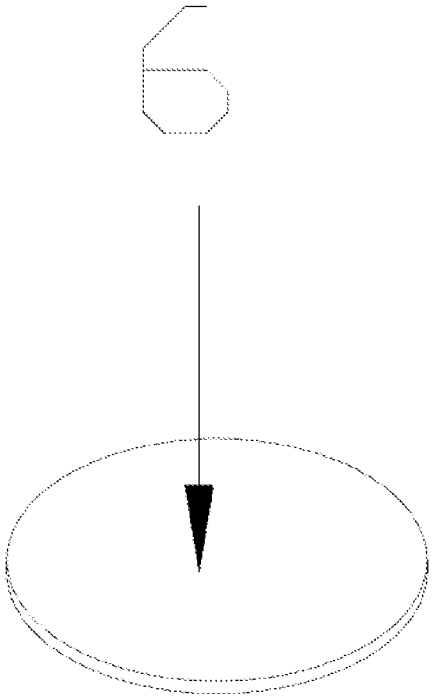
Figure 7:
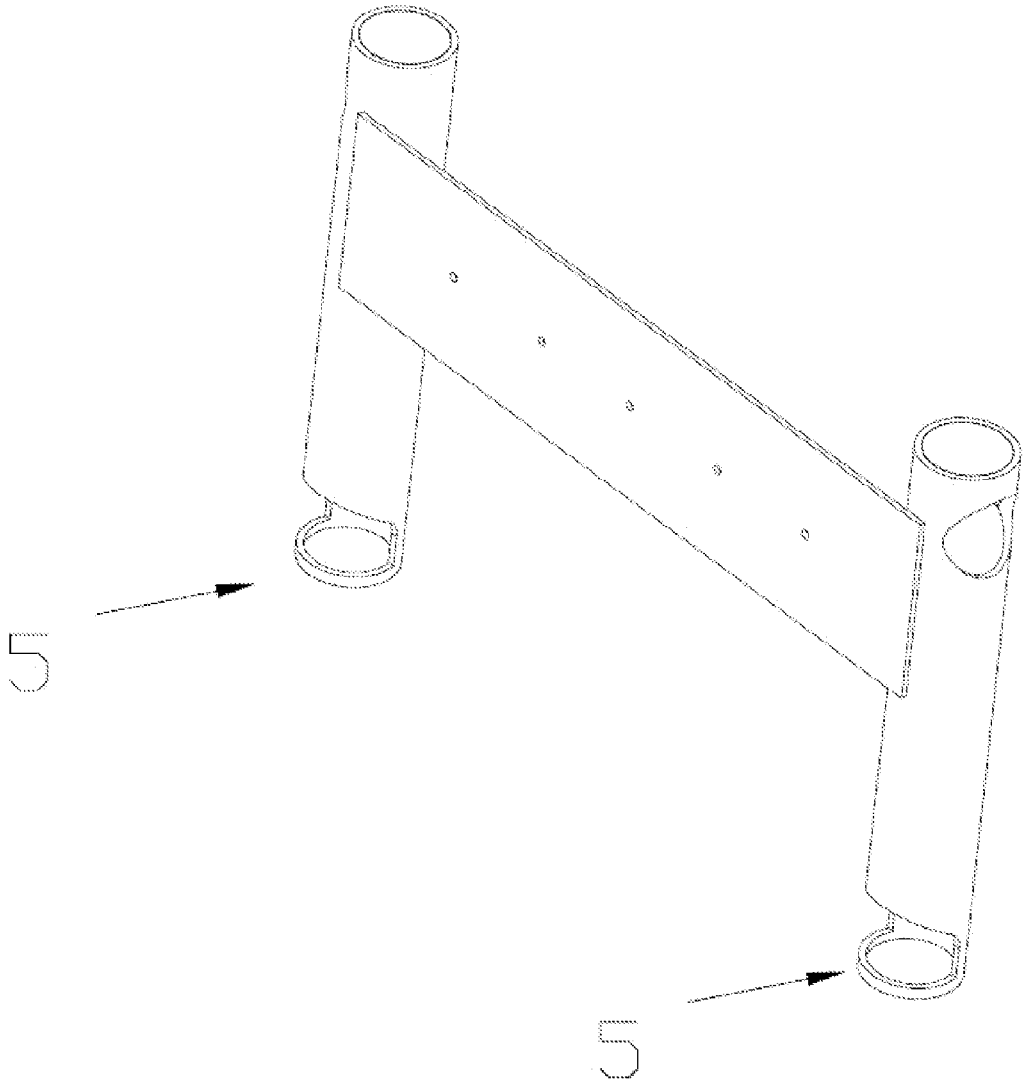
Figure 8:
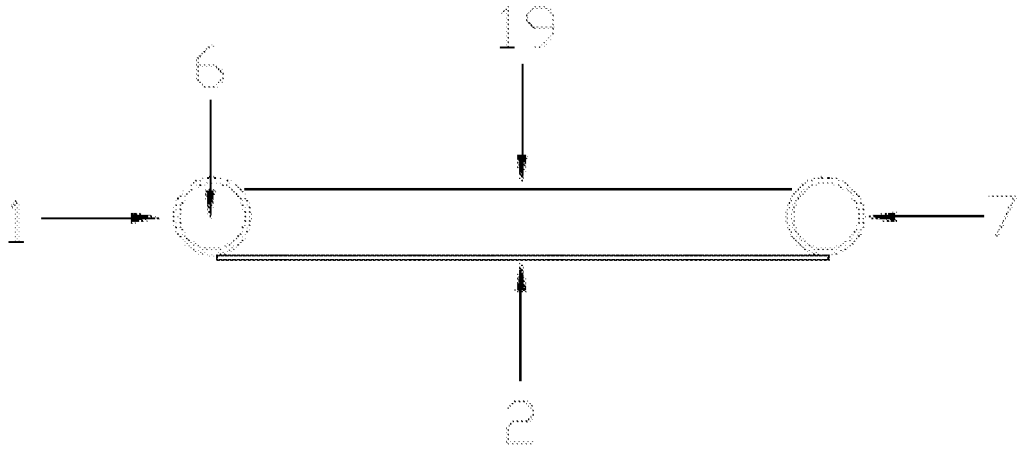
Figure 9:
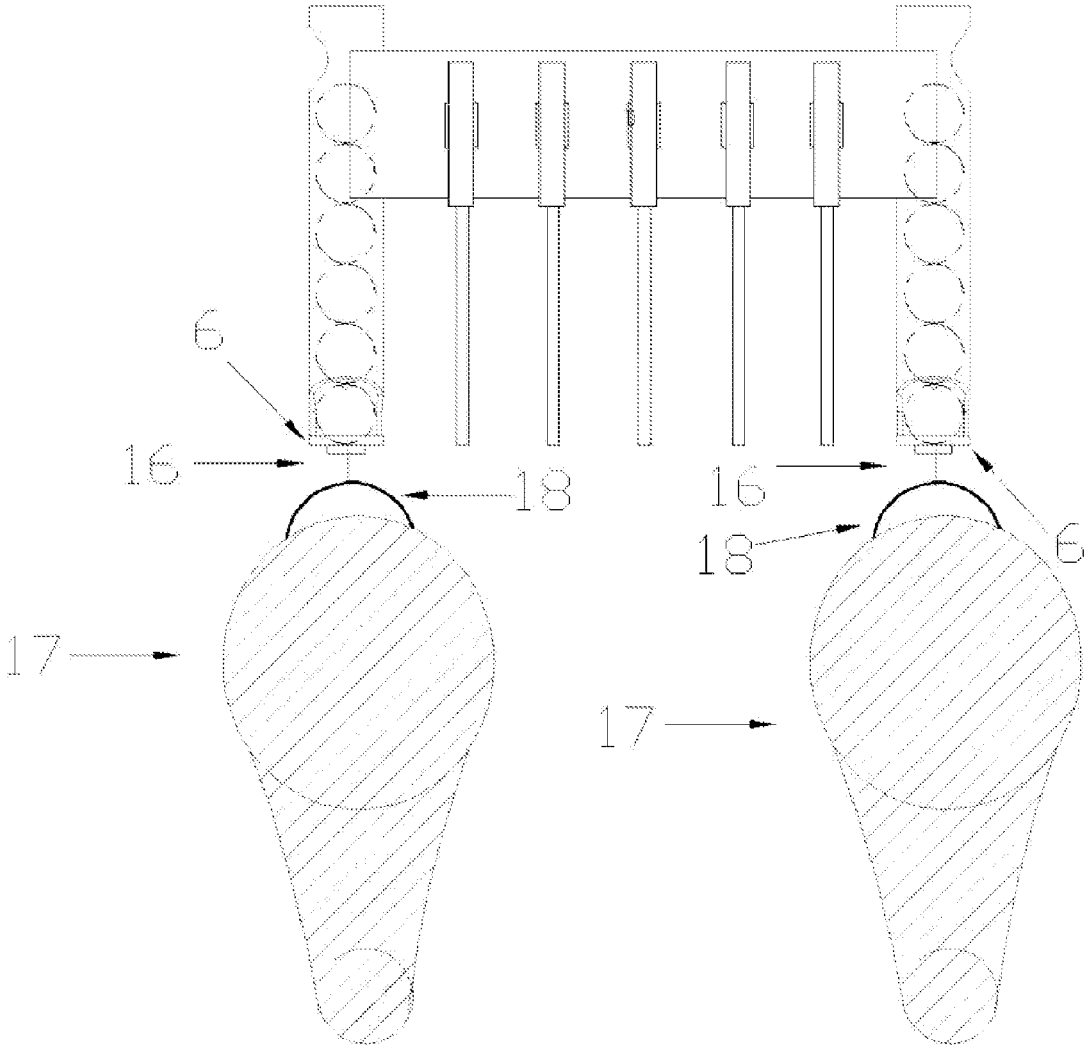

FIG. 6 a perspective view of the caps placed at the top & bottom of ball-dispensers FIG. 7 a perspective view of the invention noting the ball catch-basins FIG. 8 a detailed top down view FIG. 9 a detailed view of optional magnetic hooks with paddle bags attached Drawing Numeral Reference

| | | | | | |
|---|---|---|---|---|---|
| 1 | left ball-dispenser | 2 | faceplate | 3 | ball-input hole |
| 4 | ball-output hole | 5 | ball catch-basin | 6 | ball dispenser cap |
| 7 | right ball-dispenser | 8 | keyhole mount | 9 | clip mount hole |
| 10 | tension clip | 11 | mounting hardware | 12 | paddle handle |
| 13 | paddle head | 14 | lower mount hole | 15 | right ball-input |
| 16 | magnetic hook | 17 | paddle bag | 18 | paddle bag carrier |
| 19 | rear storage shelf | | | | |

DETAILED DESCRIPTION OF THE INVENTION

All Measures are Approximate

Design emphasis was placed on creating the invention that satisfied the following criteria:

- Functionally-effective in the storage and retrieval of table tennis paddle and balls.
- Functionally-efficient in proper housing in care and ease of access of/to equipment.
- Durability to prevent the invention from easily being damaged, no moving parts, and creating from a material that is not easily broken.

Simplification of manufacturing by reducing materials needed and complexity in design.

Design specifications allowing for reduced shipping costs due to size dimensions and weight.

Design appeal in creating an invention with proportional dimensions, smooth lines and curves. Widths of all parts kept to minimum distances while maintaining desired functionality.

Prior art has accomplished the holding of table tennis paddle and balls, this art combines pros of prior art while introducing new uses not found in prior art as indicated below.

FIG. 1 is a schematic front view of the invention, showing 5-paddles mounted on clips and a partially-transparent view of 6-balls in each ball-dispenser. This drawing provides a drawing of a fully assembled unit and where the table tennis paddles and balls would be hung/stored (respectively). Of note, balls free fall into position by natural forces of gravity and do not need any elaborate guiding mechanisms. This is an improvement over previous inventions that hold paddles and balls. This design also prevents ball jams, as the complete path is only large enough for a single ball to travel at a time.

This view also clearly represents the first paddle and ball holder design that allows preferred selection of paddle without the need to move other paddles.

Prior art had dispensed balls, but none mounted as in this art with individual paddle hangers and dispensers that also reduced the amount of dust collection from settling on the balls.

FIG. 2 is a detailed front view and is used to represent the invention parts and a depiction of faceplate 2, clip mount holes 9, without clip 10, with clip 10, and with clip 10 holding a paddle handle 12 and paddle head 13 attached/hung.

Ball dispensers 1 & 7 are identical with the exception of ball-input holes 3 & 15. Ball-input holes face to the outsides of the invention allowing for ease of input of balls to be stored in dispensers 1 & 7.

FIG. 3 is a detailed rear cut-away view of the back the left ball-dispenser 1. This view provides a view of the keyholes 8 used in both ball dispensers 1 & 7. A rear view of lower mount hole 14 is also shown here. It should be pointed out that both the keyholes 8 and mount holes 14 take screws installed from the front of the unit; accessed through the ball inputs 3 & 15 for keyholes 8, and ball outputs 4 for lower mount holes 14. It should also be noted that all lower mount holes 14 and keyholes 8 are 16" inches on center to allow for securing to standard US construction framing studs.

A cut-away view of the rear storage shelf 19 running horizontally along the rear bottom of faceplate 2 is shown. This rear storage shelf 19 can hold additional gaming accessories like gloves, tape, packages of balls etc.

FIG. 4 is a detailed right side view. Of note, viewable is the circular shaped right ball-input 15, the contoured side view of the ball-output 4, the side view of the faceplate 2, and the attached clip 10 to faceplate 2.

FIG. 5 is a detailed right side view is the same view as FIG. 4 with a partially-transparent view of a hung paddle 12 (handle) & 13 (blade).

FIG. 6 is a perspective view of the caps 6 placed at the top & bottom of ball-dispensers 1 and 7.

FIG. 7 is a perspective view of the invention without any tension clips 10. Of note here is view of ball catch-basins 5. The ball catch-basin reside directly under ball-outputs 4, and are formed by a ¼" lip that rests on a cap 6 that deters ball(s) from falling/spilling out of the dispensers 1 & 7.

FIG. 8 is a detailed top down view of the invention. Seen from above you can see that faceplate 2 is attached to the centers of ball-dispensers 1 & 7.

The rear storage shelf 19 is also shown in this view. This is the first combination table tennis paddle and ball holder invention to provide this specific auxiliary storage option that is in addition to the primary designed area(s) for holding of paddles or balls.

FIG. 9 is a detailed view showing optional magnetic hooks 16 attached to caps 6 at the bottoms of dispensers 1 & 7, attached to paddle bags 17 by paddle bag carriers 18. This is the first combination table tennis paddle and ball holder invention to provide this option.

Manufacturing Process

Using FIG. 2 & FIG. 6. to describe the manufacturing process as outlined below:

Ball-Dispenser Cap 6 Manufacture Steps a. FIG. 6 Caps 6 are laser cut from a sheet of 1045 Carbon steel.

b. Four caps 6 are required for a final assembled unit.

NOTE: FIG. 6 can be used for all numbered references for all remaining manufacturing steps.

Ball Dispensers 1 & 7 Manufacture Steps a. 1080 Carbon steel tubes (ball dispensers) 1 & 7 are cut to 12" lengths using metal cutting circular saw.

b. The ball-output holes 4 are cut by laser to specifications (allowing just enough room for a ball to be retrieved yet, not allow the ball to fall out on its own). As part of this cut, ball catch-basins are formed.

c. Ball dispensers are then sorted into two piles, lefts 1 and rights 7.

d. Ball dispensers 1 & 7 are then laser cut to provide ball-input holes 4 & 16 e. Ball dispensers 1 & 7 are then drilled to provide two mounting holes. The top hole is a keyhole mount 8 and requires a larger opening to fit the pan-head screw #6 for mounting and then several smaller successive drill holes 14 to allow the shank and/or thread diameter to slide into mounting position (once hung on a wall). The bottom holes 14 are drilled to provide additional stabilization when hung.

f. Cap 6 are welded (one each) to the top and bottom of the dispensers 1 & 7.

a. After first assembly of the left and right ball dispensers, a Quality Assurance step is added to make sure a 40 mm ball feeds through the dispensers as designed.

g. All weld locations are then polished to smooth joints.

h. Dispensers 1 & 7 are immersed in salt water to rapidly cool joints, minimizing imperfections.

i. Dispensers 1 & 7 are then immediately rinsed and towel dried to prevent corrosion.

Faceplate 2 Manufacture Steps a. Faceplates 2 made of 1045 Carbon steel sheets are cut to lengths of 16"

b. Faceplates 2 are then drilled in 5 equidistant locations from center out by 2.5" on center.

Final Assembly of Faceplate 2, Ball-Dispensers 1 & 7 (with caps 6)

a. The left 1 & right 7 dispensers are fixed to the faceplate 2 in preparation for welds.

b. Welding is completed along the faceplate 2 left and right edges affixing it to left 1 & right 7 ball dispensers. All weld locations are then polished to smooth joints.

c. Assembled units are immersed in salt water to rapidly cool d. Assembled units are then immediately rinsed and towel dried to prevent corrosion.

e. Once dried, the assembled units are then given a final inspection to insure no metal debris/residue remains.

f. Assembled units are then powder coated and left to dry, individually hung by a metal hook inserted into ball-input hole 3 or 15.

g. Assembly is now complete and ready for packing & shipping.

The embodiments of the invention in which an exclusive property or privilege is claimed are defined as follows:

1. A table tennis paddle and ball dispenser comprising: a. a left ball dispenser with a ball-input hole and a ball-output hole and a top opening and a bottom opening and a plurality of mounting holes and a mechanism for catching and holding balls for dispensing; b. a right ball dispenser with a ball-input hole and a ball-output hole and a top opening and a bottom opening and a plurality of mounting holes and a mechanism for catching and holding balls for dispensing; c. a plurality of tension clips for holding paddles; d. a plurality of ball dispenser caps; and e. a faceplate having a left end and a right end and a plurality of mounting holes wherein said left ball dispenser is attached to said left end of said faceplate and said right ball dispenser is attached to said right end of faceplate and said ball dispenser caps are attached to the top opening and bottom opening of said left ball dispenser and said right ball dispenser and said tension clips are attached to said faceplate by a plurality of bolts, lock-washers and nuts.

2. The paddle and ball dispenser of claim 1 further comprising support structures for holding paddle containers are hung on the bottom of said caps attached to the bottom of said left-ball dispenser and the bottom of said right ball dispenser and a support structure for holding additional equipment is configured to be attached to said faceplate.

3. The paddle and ball dispenser of claim 2 wherein the said support structures for holding paddles containers are magnetic hooks.

4. The paddle and ball dispenser of claim 2 wherein the said support structure for holding additional equipment is a rear storage shelf.

5. The paddle and ball dispenser of claim 1 wherein said left ball dispenser and said right ball dispenser are cylindrical in shape.

6. The paddle and ball dispenser of claim 1 wherein said left ball dispenser ball-input hole is located near the top left side of the left ball dispenser and is circular in shape.

7. The paddle and ball dispenser of claim 1 wherein said right ball dispenser ball-input hole is located near the top right side of the right ball dispenser and is circular in shape.

8. The paddle and ball dispenser of claim 1 wherein said left ball dispenser and said right ball dispenser ball-output holes are located on the front facing bottom area of the left ball dispenser and right ball dispenser.

9. The paddle and ball dispenser of claim 1 wherein the mechanism for catching and holding balls for dispensing comprises a raised to deter balls from spilling out.

10. The paddle and ball dispenser of claim 1 wherein said faceplate is attached to said ball dispensers by means of welding.

11. The paddle and ball dispenser of claim 1 wherein the said caps of are attached to the said ball dispensers by means of welding.

* * * * *